US010141639B2

(12) United States Patent
Saitou et al.

(10) Patent No.: US 10,141,639 B2
(45) Date of Patent: Nov. 27, 2018

(54) ANTENNA

(71) Applicants: Tyco Electronics Japan G.K., Kanagawa (JP); Denso Corporation, Aichi-ken (JP)

(72) Inventors: Tatsuo Saitou, Aihi-ken (JP); Masahiro Ooshiro, Aichi-ken (JP); Tohru Yamamoto, Kanagawa (JP); Takeshi Akitaya, Kanagawa (JP)

(73) Assignees: Tyco Electronics Japan G.K., Kanagawa (JP); Denso Corporation, Aichi-ken (JP)

( * ) Notice: Subject to any disclaimer, the term of this patent is extended or adjusted under 35 U.S.C. 154(b) by 81 days.

(21) Appl. No.: 15/161,792

(22) Filed: May 23, 2016

(65) Prior Publication Data

US 2016/0351992 A1 Dec. 1, 2016

(30) Foreign Application Priority Data

May 25, 2015 (JP) ..... 2015-105806

(51) Int. Cl.

| | |
|---|---|
| ***H01Q 1/50*** | (2006.01) |
| ***H01Q 1/12*** | (2006.01) |
| ***H01Q 1/32*** | (2006.01) |
| ***H01Q 1/22*** | (2006.01) |

(52) U.S. Cl.

CPC ..... *H01Q 1/50* (2013.01); *H01Q 1/1207* (2013.01); *H01Q 1/2291* (2013.01); *H01Q 1/325* (2013.01); *H01Q 1/3291* (2013.01)

(58) Field of Classification Search

CPC .... H01Q 1/325; H01Q 1/3258; H01Q 1/3266; H01Q 1/3275; H01Q 1/3283; H01Q 1/3291; H01Q 1/50; H01Q 1/1207; H01R 2201/02; H01R 2201/26

See application file for complete search history.

(56) References Cited

U.S. PATENT DOCUMENTS

| | | | | |
|---|---|---|---|---|
| 5,532,703 | A | 7/1996 | Stephens et al. | |
| 2003/0016177 | A1 * | 1/2003 | Deguchi ..... | H01Q 1/242 343/702 |

FOREIGN PATENT DOCUMENTS

| | | | |
|---|---|---|---|
| JP | 9260916 | A | 10/1997 |
| JP | H10-117108 | A | 5/1998 |
| JP | 2003-032020 | A | 1/2003 |
| JP | 2011134701 | A | 7/2011 |
| JP | 2013201511 | A | 10/2013 |

OTHER PUBLICATIONS

Japanese Notification of Reasons for Refusal and English translation, dated Jun. 13, 2018 , 5 pages.
Abstract of JPH10117108A, dated May 6, 1998, 1 page.
Abstract of JP2003032020A, dated Jan. 31, 2003, 1 page.

* cited by examiner

*Primary Examiner* — Robert Karacsony
(74) *Attorney, Agent, or Firm* — Barley Snyder

(57) ABSTRACT

An antenna is disclosed. The antenna has an electrical cable, an antenna body including an element part and a ground part, the element part having an electric wire connecting part electrically connected with the electrical cable, and an antenna holder having an antenna holding part connected to the antenna body and a cable holding part holding the electrical cable.

14 Claims, 6 Drawing Sheets

ANTENNA

CROSS-REFERENCE TO RELATED APPLICATION

This application claims the benefit of Japanese Patent Application No. 2015-105806, filed May 25, 2015.

FIELD OF THE INVENTION

The present invention relates to an antenna, and more particularly, to an antenna suitable for wireless communication with in-vehicle apparatuses.

BACKGROUND

As is known in the prior art, an in-vehicle antenna may be installed as an element of a Bluetooth® module of an electronic apparatus for vehicles, such as a navigation apparatus. An antenna fabricated through sheet metal working of a metal plate is often used as such an antenna in order to reduce costs (for example, JP 2013-201511 A).

Such a sheet metal antenna is connected with a coaxial cable to transmit or receive a signal to or from an electronic apparatus; however, the coaxial cable may be pulled at a time when the sheet metal antenna is installed on a casing of the electronic apparatus or during work such as mating of a connector. This may cause unsoldering at the soldered part where the coaxial cable is connected to the sheet metal antenna or disconnection of the coaxial cable at the soldered part, which may result in deterioration in integrity of the soldered part. Conversely, defects do not occur when the work is performed slowly and carefully, however, production efficiency is impaired. In addition, in-vehicle apparatuses are in mounting environment in which vibration or temperature change is continuously applied. Stress caused by vibration of the coaxial cable may be applied to the soldered part as well, and cracks may easily occur on the solder through the repeated increase and decrease of temperature.

To avoid a tensile load applied to the soldered part, the coaxial cable may have a sufficient extra length. In the in-vehicle apparatuses, however, an excessively long cable may disadvantageously cause resonation that applies stress to the soldered part, or may contact with other components to cause abnormal noise. It is thus difficult to simultaneously solve the aforementioned disadvantages.

JP2011-134701 A discloses a fixing configuration of an antenna and a cable that seeks to address these concerns. In this fixing configuration, a cable 400 is fixed to a resin radiator 200 having an antenna pattern 220 with use of two cable connection pins 300. In the fixing configuration disclosed in JP2011-134701 A, however, a signal line 450 of the cable 400 is not soldered to the antenna pattern 220. Therefore, connection reliability between the signal line 450 and the antenna pattern 220 is low. Further, the cable connection pins 300 in JP2011-134701 A are fabricated through a drawing process of an elastic metal plate, and are fixed, through thermal fusion, to the resin radiator 200 that is separately fabricated. Accordingly, work to fix the cable 400 to the connection pins 300 is necessary. Both this work and the manufacturing of the cable connection pins 300 increase costs.

SUMMARY

An object of the invention, among others, is to provide an antenna at low cost in which integrity of the soldered part is maintained even if an electrical cable such as a coaxial cable is pulled. The disclosed antenna has an electrical cable, an antenna body including an element part and a ground part, the element part having an electric wire connecting part electrically connected with the electrical cable, and an antenna holder having an antenna holding part connected to the antenna body and a cable holding part holding the electrical cable.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an in-vehicle antenna. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
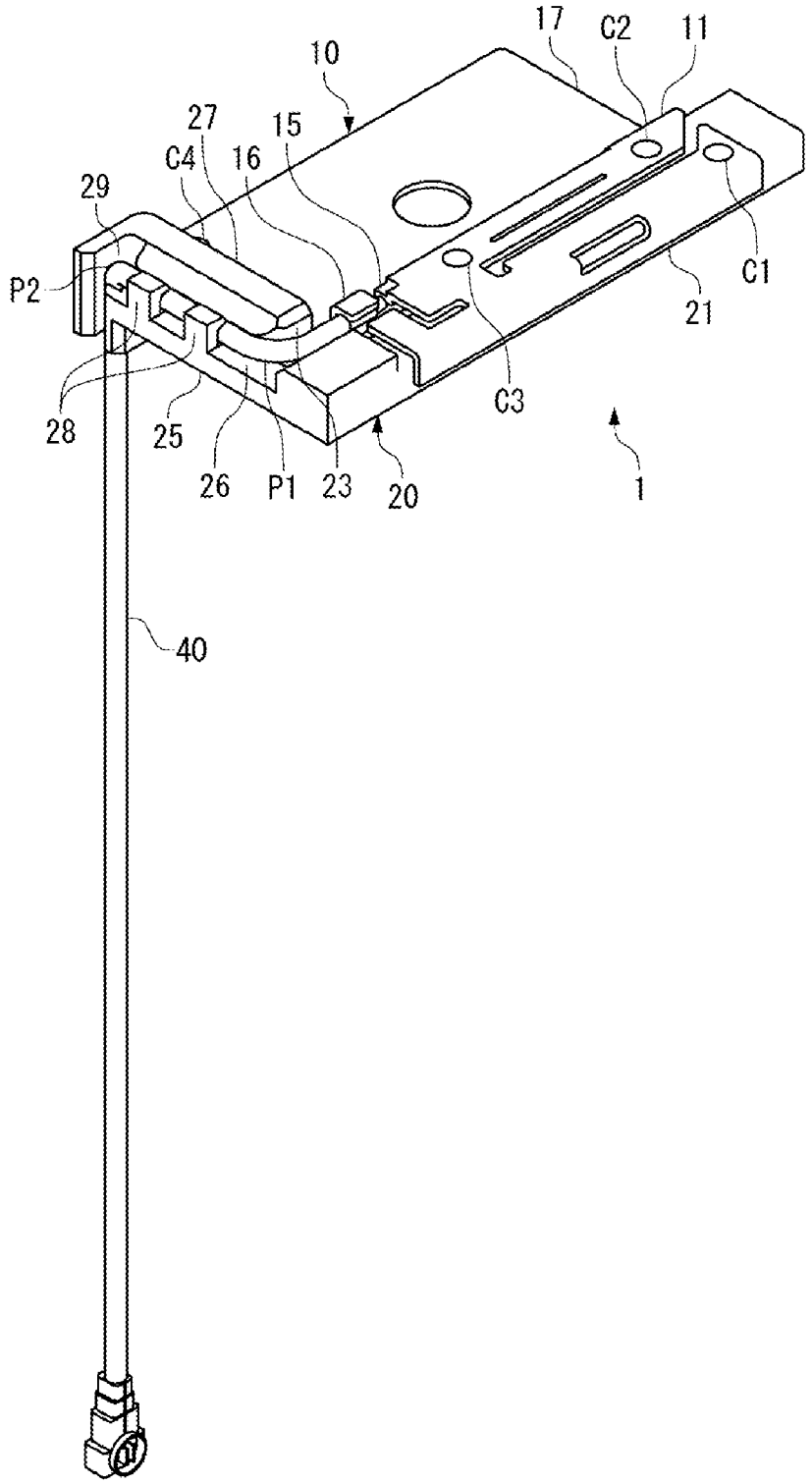
FIG. 1 is a front perspective view of an in-vehicle antenna according to the invention.
Figure 2:
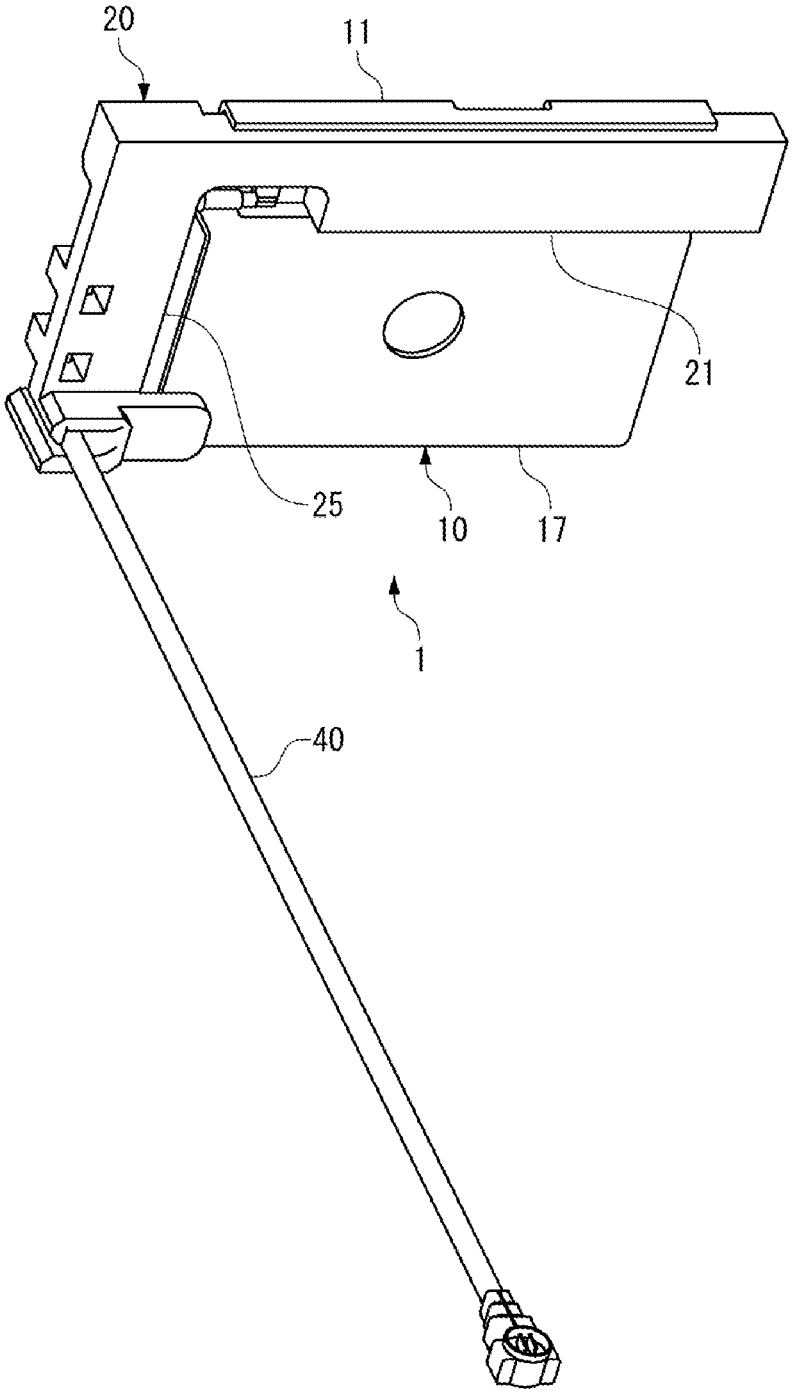
FIG. 2 is a back perspective view of the in-vehicle antenna of FIG. 1.

An in-vehicle antenna 1 according to the present invention is shown generally in FIG. 1. The in-vehicle antenna 1 includes an antenna body 10, an antenna holder 20, and a coaxial cable 40. Throughout the following description, the side of the in-vehicle antenna 1 illustrated in FIG. 1 is referred to as the front side, and side of the in-vehicle antenna 1 illustrated in FIG. 2 is referred to as the back side. The in-vehicle antenna 1 may be formed of an inexpensive metal material such as iron and iron-based alloy. The major components of the invention will now be described in greater detail.

Figure 3A:
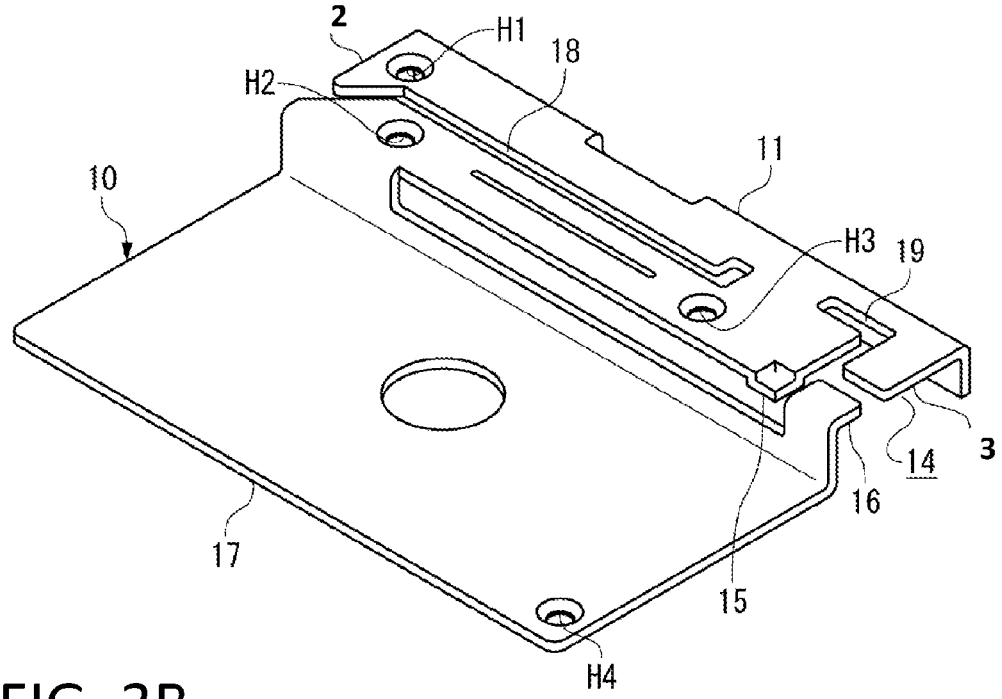
FIG. 3A is a perspective view of an antenna body of the in-vehicle antenna of FIG. 1.
Figure 3B:
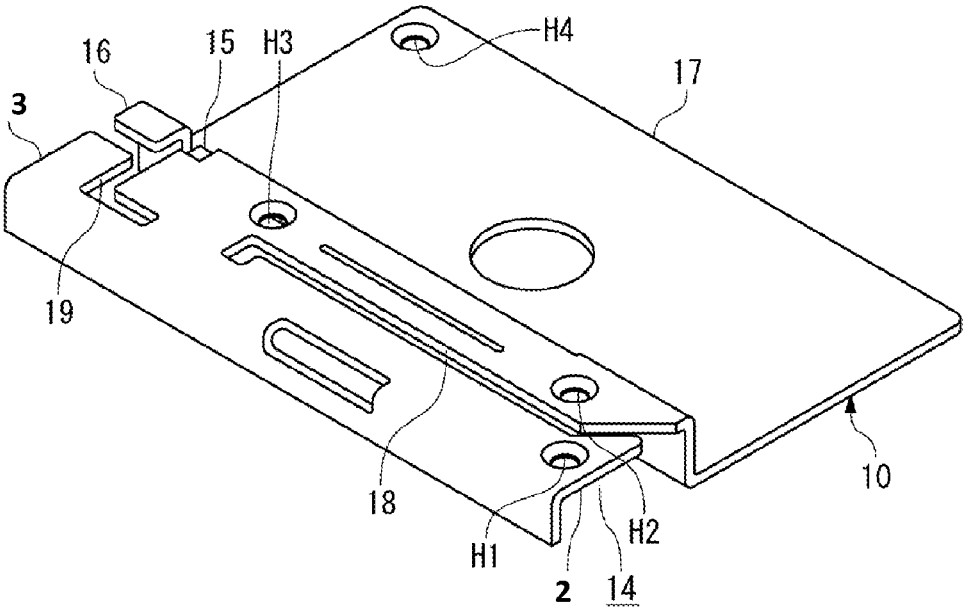
FIG. 3B is a perspective view of the antenna body of FIG. 3A.

The antenna body 10 may be fabricated through sheet metal working of a metal plate. As illustrated in FIGS. 3A and 3B, the antenna body 10 includes an element part 11 and a ground part 17 corresponding to the element part 11. The element part 11 and the ground part 17 are integrally formed through sheet metal working and are arranged in parallel to each other.

The element part 11 according to the present embodiment includes, in order to support two frequency bands, two antenna elements 12 and 13 respectively having slits 18 and 19. This configuration is merely exemplary and does not limit the present invention. The element part 11 has a u-shaped cross section including a receiving groove 14. The element part 11 is provided with three staking holes H1, H2, and H3 each penetrating the element part 11 from a front surface to a back surface thereof. Further, the element part 11 includes a first soldered part 15 and a second soldered part 16.

The ground part 17 is in contact with a conductive part of a casing of an unillustrated electronic apparatus, thereby functioning as a ground of the element part 11, together with the casing. As illustrated in FIGS. 3A and 3B, the ground part 17 is also provided with a staking hole H4 that penetrates the ground part 17 from a front surface to a back surface thereof.

Figure 4A:
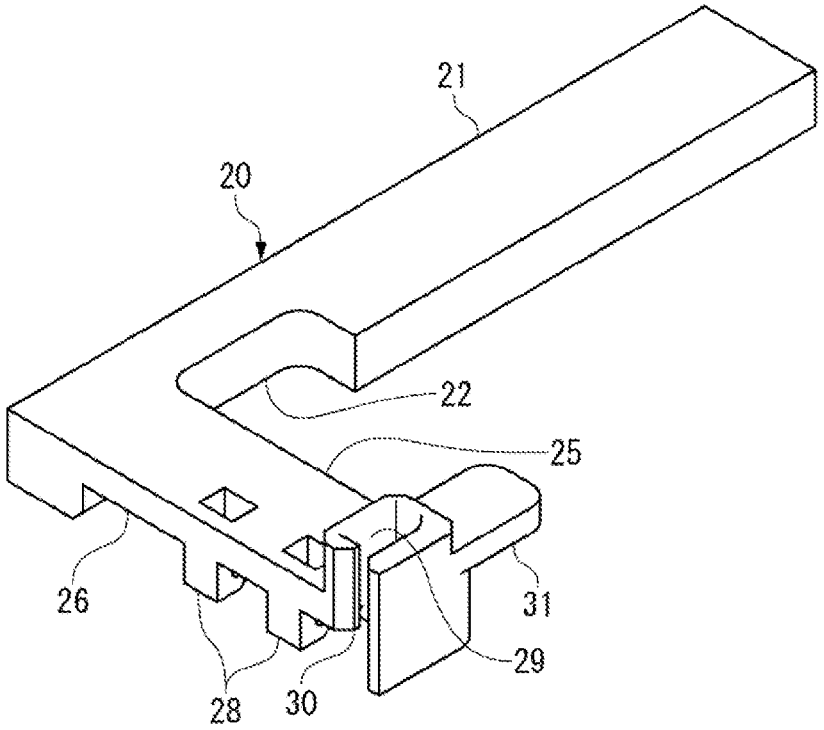
FIG. 4A is a back perspective view of an antenna holder of the in-vehicle antenna of FIG. 1.
Figure 4B:
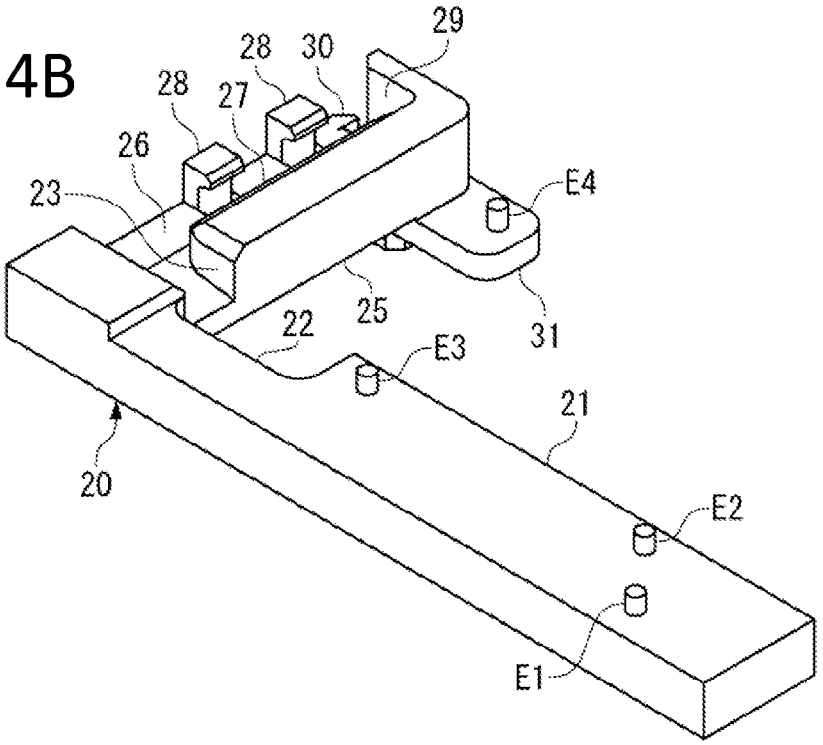
FIG. 4B is a front perspective view of the antenna holder of FIG. 4A.

The antenna holder 20 is integrally formed through injection molding of a resin having electric insulation property. As illustrated in FIGS. 4A and 4B, the antenna holder 20 includes an antenna holding part 21 and a cable holding part 25. One end of the antenna holding part 21 and one end of the cable holding part 25 are connected with each other to form an L-shaped structure.

The antenna holding part 21 has a substantially rectangular parallelepiped shape with staking bosses E1, E2, and E3 provided on a back side thereof. The antenna holding part 21 has, near a part connected to the cable holding part 25, a constriction 22 smaller in width than other parts of the antenna holding part 21. In the antenna holding part 21, the side provided with the constriction 22 is referred to as inner side, and the side opposite thereto is referred to as the outer side; the inner side and the outer side of the cable holding part 25 are also defined in a similar manner.

The cable holding part 25 includes a holding floor 26, a holding wall 27 standing from one end in the width direction of the holding floor 26, and holding claws 28. The holding claws 28 each stand from the other end in the width direction of the holding floor 26 and are opposed to the holding wall 27 with an interval. One end of the holding wall 27 is cut out to form a path 23 through which the coaxial cable 40 passes. The other end of the holding wall 27 is bent in an L-shape and is continuous with a holding slot 29 that is connected with back side of the holding floor 26. The holding slot 29 is provided with a holding claw 30 projecting toward an inside of the holding slot 29. A tab 31 is provided on back side of the holding wall 27, and is provided with a heat staking boss E4 on front side thereof.

Figure 5A:
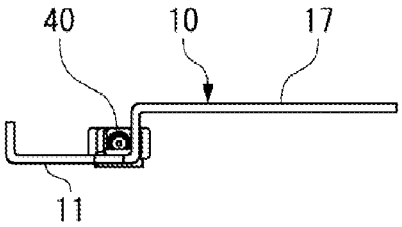
FIG. 5A is a back view of an antenna body and a coaxial cable of the in-vehicle antenna of FIG. 1.
Figure 5B:
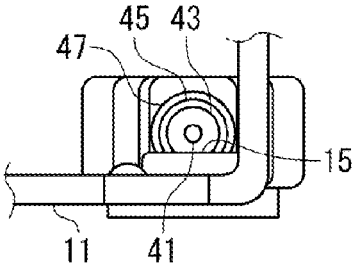
FIG. 5B is an enlarged view of FIG. 5A.
Figure 5C:
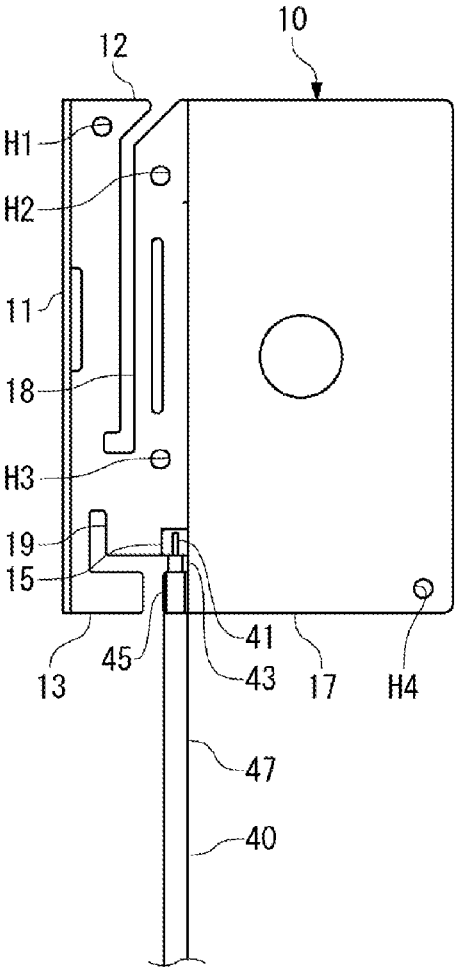
FIG. 5C is a bottom view of the antenna body and coaxial cable of FIG. 5A.

The coaxial cable 40, as shown in FIG. 5B, includes a core wire 41, an insulator 43, a braid 45, and an outer sheath 47. The coaxial cable 40 may alternatively be any type of electrical cable known to those with ordinary skill in the art.

An outline of a procedure of assembling the in-vehicle antenna 1 will now be described with reference to FIGS. 5A-6C.

First, the coaxial cable 40 is soldered to the antenna body 10 as illustrated in FIGS. 5A to 5D. The core wire 41 of the coaxial cable 40 and the first soldered part 15 of the antenna body 10 are aligned, the braid 45 of the coaxial cable 40 and the second soldered part 16 of the antenna body 10 are aligned, and then the soldering is performed at these two aligned points. Note that illustration of the solder itself is omitted in FIGS. 5A to 5D and FIGS. 6A to 6C.

Figure 6A:
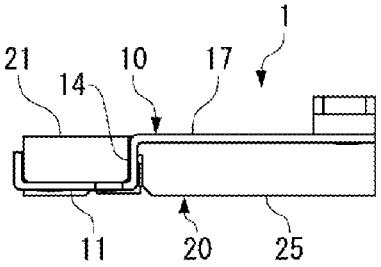
FIG. 6A is a back view of the in-vehicle antenna of FIG. 1.
Figure 6B:
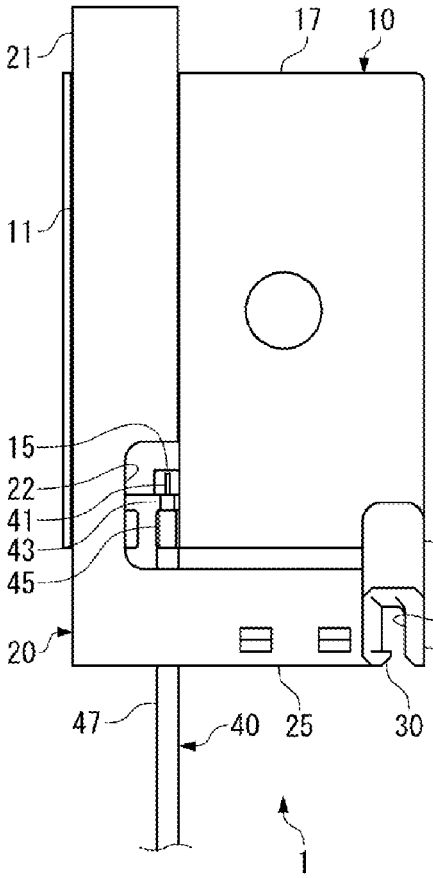
FIG. 6B is a bottom view of the in-vehicle antenna of FIG. 1.
Figure 6C:
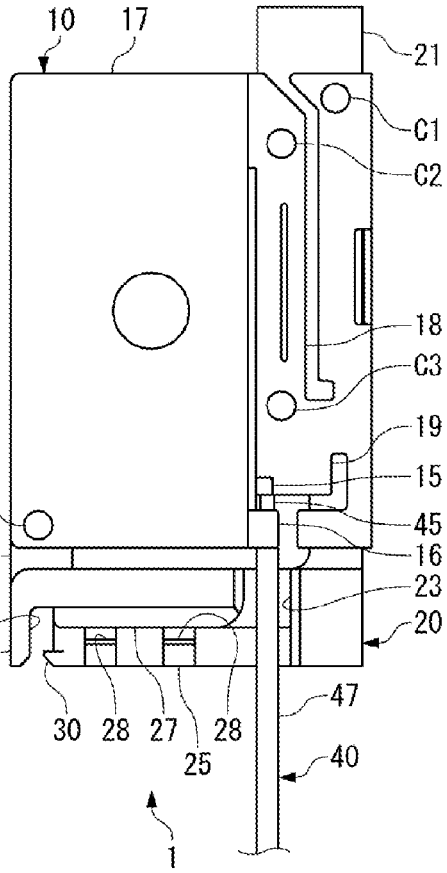
FIG. 6C is a plan view of the in-vehicle antenna of FIG. 1.

Then, as illustrated in FIGS. 6A to 6C, the antenna body 10 soldered with the coaxial cable 40 is assembled to the antenna holder 20. The antenna holder 20 is pushed down such that the antenna holding part 21 is fitted into the receiving groove 14 with substantially no gap. At this time, the staking bosses E1, E2, E3, and E4 are respectively fitted into the staking holes H1, H2, H3, and H4, which results in a precise positioning between the antenna body 10 and the antenna holder 20.

After the antenna body 10 and the antenna holder 20 are fitted to a predetermined positional relationship, the bosses E1, E2, E3, and E4 projected respectively from the staking holes H1, H2, H3, and H4 are thermally fused to perform heat staking. The antenna body 10 and the antenna holder 20 are fixed to each other by virtue of the heat staking. The coaxial cable 40 is still straight. Therefore, work to allow the cable holding part 25 to hold the coaxial cable 40 is then performed.

Figure 5D:
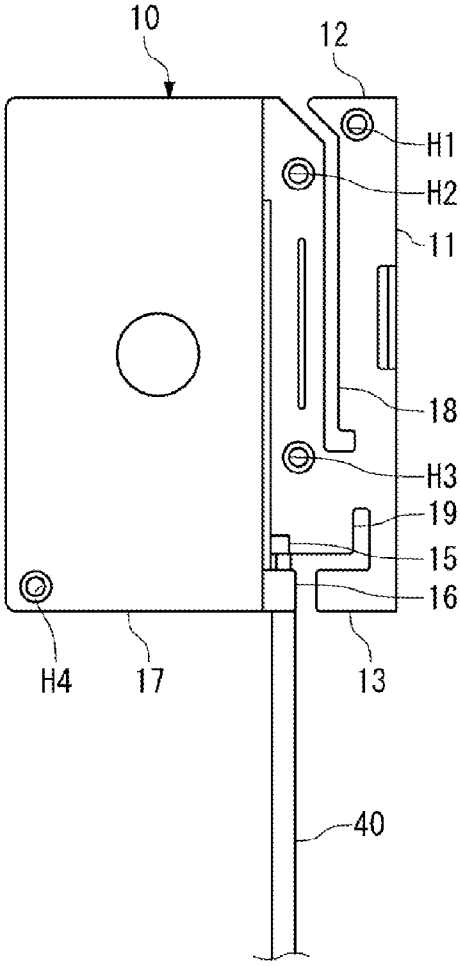
FIG. 5D is a plan view of the antenna body and coaxial cable of FIG. 5A.

As illustrated in FIG. 5D, the coaxial cable 40 is straightly drawn out from the second soldered part 16. As illustrated in FIG. 1, the coaxial cable 40 passes through the constriction 22 and the path 23, is then bent toward the inner side of the cable holding part 25 in a substantially perpendicular direction that is different from a direction in which the coaxial cable 40 extends from the second soldered part 16, and is held by the holding wall 27 and the holding claws 28 in a space between the holding wall 27 and the holding claws 28. Further, a front part of the coaxial cable 40 located on the other end of the holding wall 27 and the holding claws 28 is bent toward the back side, and extends to the back side through the holding slot 29.

The first soldered part 15 and the second soldered part 16 serving as the electric wire connecting part are so disposed as not to be overlapped with the antenna holding part 21 and the cable holding part 25. This makes possible the above-described routing of the coaxial cable 40, in which the cable 40 is routed without being bent unnecessarily.

Next, the function and effects of the in-vehicle antenna 1 are described.

In the in-vehicle antenna 1, the antenna holder 20 integrally includes the cable holding part 25 that holds the coaxial cable 40 and the antenna holding part 21 that holds the element part 11 to ensure the rigidity of the antenna body 10. Accordingly, as compared with a case where a member corresponding to the cable holding part 25 is individually fabricated and assembled, it is possible to reduce the cost of components and to reduce cost relating to the assembly.

The antenna holder 20 includes both the antenna holding part 21 and the cable holding part 25. Thus, pull force occurring when the coaxial cable 40 is pulled is received only by the antenna holder 20 through the antenna holding part 21. This makes it possible to avoid the force from being directly applied to the antenna body 10 when the coaxial cable 40 is pulled. Accordingly, unnecessary stress does not occur on the antenna body 10, which makes it possible to ensure performance of an antenna.

Further, the coaxial cable 40 may be pulled during the work in which the in-vehicle antenna 1 is installed in a predetermined position in a vehicle, and vibration or impact may be applied to the coaxial cable 40 after installed in a vehicle. If the pull force occurs on the coaxial cable 40, the pull force is not applied to the first soldered part 15 and the second soldered part 16 because the coaxial cable 40 is held by the cable holding part 25. This makes it possible to ensure integrity of the soldered parts. In particular, in the in-vehicle antenna 1, the coaxial cable 40 is bent in a direction different from a direction in which the coaxial cable 40 extends from the second soldered part 16 at a position P1 where the coaxial cable 40 has passed through the path 23 and a position P2 at which the coaxial cable 40 extends from the front side to the back side. Accordingly, in FIG. 1, if the coaxial cable 40 is pulled downward, the pull force transmitted in an axial line direction is small at the space between the holding wall 27 and the holding claws 28 because the direction of the coaxial cable 40 is changed at the position P2. The same applies to the position P1. If the coaxial cable 40 drawn out to the back side is pulled, the pull force is hardly transmitted to the first soldered part 15 and the second soldered part 16.

The coaxial cable 40 is held in the space between the holding wall 27 and the holding claws 28 and held by the holding claw 30 in the slot 29. This suppresses transmission of the pull force to the first soldered part 15 and the second soldered part 16. In addition, in the in-vehicle antenna 1 according to the present embodiment, the coaxial cable 40 is routed in a direction different from the direction in which the coaxial cable 40 extends from the second soldered part 16. This makes it possible to suppress transmission of the pull force to the first soldered part 15 and the second soldered part 16 more reliably.

The antenna body 10 and the antenna holder 20 are fixed to each other by the heat staking C1, C2, C3, and C4 at a plurality of positions (four positions). Therefore, the antenna body 10 and the antenna holder 20 are fixed with sufficient strength. The heat staking C1, C2, C3, and C4 are formed by respectively inserting the staking bosses E1, E2, E3, and E4 into the staking holes H1, H2, H3, and H4 and performing thermal fusion. In particular, heat-staked parts by the staking holes H1 and H2 and the staking bosses E1 and E2 are provided on both sides of the slit 18 that is used to form the antenna device 12. A distance of the slit 18 is maintained even if vibration and impact is applied to the antenna body 10. Therefore, it is possible to maintain characteristics of the antenna body 10.

Further, in the in-vehicle antenna 1, the cable holding part 25 of the antenna holder 20 is disposed along the ground part 17, and holds the ground part 17 through the staking boss H4 of the tab 31 that is partially overlapped with the ground part 17. The antenna holding part 21 is fitted into the receiving groove 14 to hold the element part 11, and the antenna body 10 is accordingly held while maintaining rigidity of the entire antenna body 10. This makes it possible to provide the in-vehicle antenna 1 with high vibration resistance.

In the function of the in-vehicle antenna 1, the element part 11 receives radio waves emitted from a communication terminal within a communication distance, and the received radio waves are transmitted as electric signals to a wireless communication circuit in a wireless communication module. Further, electric signals generated in the wireless communication circuit are transmitted to the element part 11 through the coaxial cable 40 (see FIG. 1), and are emitted as radio waves toward a communication terminal within the communication distance.

The configuration described in the above embodiment may be selected or may be appropriately modified to any other configuration without departing from the scope of the present invention. The in-vehicle antenna 1 according to the present embodiment suppresses transmission of the pull force to the second soldered part 16 by the element in which the coaxial cable 40 is held by the holding wall 27, the holding claws 28, etc., and the element in which the coaxial cable 40 is routed in a direction different from the direction in which the coaxial cable 40 extends from the second soldered part 16. However, the present invention may suppress the transmission of the pull force to the second soldered part 16 only by one of the elements. In addition, when the coaxial cable 40 is routed in such a different direction, the coaxial cable 40 may be bent only once. Also, the in-vehicle antenna 1 has been described as an example in the present embodiment; however, the present invention is widely applicable to antennae other than an in-vehicle antenna.

What is claimed is:

1. An antenna, comprising:

an electrical cable;

an antenna body including an element part and a ground part integrally formed from a metal plate, the element part having an electric wire connecting part electrically connected with the electrical cable; and a resin antenna holder having an antenna holding part connected to the antenna body and a cable holding part holding the electrical cable in a direction different from a direction in which the electrical cable extends from the electric wire connecting part, the antenna holding part having a plurality of staking bosses and a constriction smaller in width than other parts of the antenna holding part, the cable holding part having a holding floor, a holding wall standing from a first end in the width direction of the holding floor, and a plurality of first holding claws, the antenna holder preventing pull forces and vibration occurring on the electrical cable from being transmitted to the electric wire connecting part.

2. The antenna of claim 1, wherein the antenna holder is an electrically insulating material.

3. The antenna of claim 1, wherein the plurality of first holding claws each stand with an interval along an opposite second end in a width direction of the holding floor and are opposed to the holding wall.

4. The antenna of claim 3, wherein a first end of the holding wall is cut out to form a path and an opposite second end of the holding wall is bent in an L-shape.

5. The antenna of claim 4, wherein the L-shape of the holding wall is continuous with a holding slot extending through the holding floor.

6. The antenna of claim 5, wherein the holding slot has a second holding claw projecting toward an inside of the holding slot.

7. The antenna of claim 6, wherein the electrical cable extends through the constriction and the path, and is perpendicularly bent to extend between the holding wall and the holding claws.

8. The antenna of claim 7, wherein the electrical cable extends to the back side of the holding wall through the holding slot.

9. The antenna of claim 1, wherein the staking bosses are fixed to staking holes formed in the element part through heat staking.

10. The antenna according to claim 1, wherein the electric wire connecting part of the element part is disposed at a position that does not overlap with the antenna holding part and the cable holding part.

11. The antenna of claim 1, wherein the element part has a u-shaped cross section forming a receiving groove.

12. The antenna of claim 11, wherein the antenna holding part is fitted into the receiving groove.

13. The antenna of claim 12, wherein the cable holding part is disposed along the ground part.

14. The antenna of claim 13, wherein a tab of the cable holding part partially overlaps and holds the ground part.

* * * * *